US012215682B2

(12) United States Patent
Stewart et al.

(10) Patent No.: US 12,215,682 B2
(45) Date of Patent: Feb. 4, 2025

(54) PERISTALTIC PUMP ROTOR, STATOR AND ROLLER ARRANGEMENT

(71) Applicant: The University of Melbourne, Melbourne (AU)

(72) Inventors: Alastair Stewart, Melbourne (AU); Xumei Gao, Melbourne (AU)

(73) Assignee: The University of Melbourne, Melbourne (AU)

( * ) Notice: Subject to any disclaimer, the term of this patent is extended or adjusted under 35 U.S.C. 154(b) by 112 days.

(21) Appl. No.: 17/910,408

(22) PCT Filed: Mar. 11, 2021

(86) PCT No.: PCT/AU2021/050214

§ 371 (c)(1),
(2) Date: Sep. 9, 2022

(87) PCT Pub. No.: WO2021/179046

PCT Pub. Date: Sep. 16, 2021

(65) Prior Publication Data

US 2023/0129810 A1 Apr. 27, 2023

(30) Foreign Application Priority Data

Mar. 11, 2020 (AU) ..... 2020900744

(51) Int. Cl.
*F04B 43/12* (2006.01)

(52) U.S. Cl.
CPC ..... *F04B 43/1253* (2013.01); *F04B 43/12* (2013.01); *F04B 43/1269* (2013.01); *F04B 43/1292* (2013.01)

(58) Field of Classification Search
CPC .. F04B 43/1253; F04B 43/12; F04B 43/1269; F04B 43/1292
See application file for complete search history.

(56) References Cited

U.S. PATENT DOCUMENTS 6,296,460 B1 * 10/2001 Smith ..... F04B 43/14 417/475
8,104,497 B2 * 1/2012 Unger ..... F16K 99/0059 137/833

(Continued)

FOREIGN PATENT DOCUMENTS

CN 108361179 A * 8/2018 ..... F04B 43/1223
EP 1662142 A1 5/2006
WO 2012/048261 A2 4/2012

OTHER PUBLICATIONS

Extended European Search Report, Application No./Patent No. 21767410.0-1004 / 4118336 PCT/AU2021050214, dated Feb. 1, 2024.

(Continued)

*Primary Examiner* — Nathan C Zollinger
(74) *Attorney, Agent, or Firm* — Mintz Levin Cohn Ferris Glovsky and Popeo, P.C.

(57) ABSTRACT

The invention provides a rotor for a peristaltic pump, the rotor comprising a body for rotation about an axis, the body having a first side and a second side, the body supporting a plurality of spaced first rollers extending from the body on the first side, the first rollers positioned at a first common radius from the axis, the body further supporting a plurality of spaced second rollers extending from the body on the second side, the second rollers positioned at a second common radius from the axis. The invention extends to a peristaltic pumping unit comprising such a rotor assembled with a first stator and a second stator, the first stator having one or more compressible fluid channels arranged to be compressed by said first rollers and the second stator having one or more compressible fluid channels arranged to be compressed by said second rollers. The invention also concerns a stator for a peristaltic pump, having a body with a planar surface and two or more fluid channels, each fluid (Continued)

channel having a compressible arcuate portion on or in the planar surface of the stator, the arcuate portions arranged to be compressed by a plurality of rollers mounted on a rotor, the arcuate portions each connecting to further portions of the fluid channel extending in a direction away from the planar surface such that the fluid channels take a three dimensional path within the body of the stator.

23 Claims, 9 Drawing Sheets

(56) References Cited

U.S. PATENT DOCUMENTS

| | | | | |
|---|---|---|---|---|
| 9,618,129 | B2 * | 4/2017 | Block, III | F16K 99/0023 |
| 2014/0271273 | A1 * | 9/2014 | Carpenter | F04B 43/1261 417/412 |
| 2017/0258979 | A1 | 9/2017 | Fulkerson et al. | |
| 2018/0058438 | A1 * | 3/2018 | Ochoa | A61M 1/75 |
| 2018/0066646 | A1 | 3/2018 | Himmelmann | |
| 2018/0149152 | A1 | 5/2018 | Asai et al. | |
| 2018/0209552 | A1 | 7/2018 | Gould et al. | |
| 2019/0184076 | A1 | 6/2019 | Gourlay | |

OTHER PUBLICATIONS

International Search Report corresponding to International Patent Application No. PCT/AU2021/050214 dated Apr. 23, 2021 (7 pages).

Written Opinion corresponding to International Patent Application No. PCT/AU2021/050214 dated Apr. 23, 2021 (8 pages).

* cited by examiner

PERISTALTIC PUMP ROTOR, STATOR AND ROLLER ARRANGEMENT

CROSS-REFERENCES TO RELATED APPLICATIONS

This application is a U.S. national phase application, pursuant to 35 U.S.C. § 371, of International Patent Application No. PCT/AU2021/050214, filed Mar. 11, 2021, designating the United States, which claims the benefit of and priority to Australian Patent Application No. 2020900744, filed Mar. 11, 2020, the entire contents of which are hereby expressly incorporated by reference herein.

FIELD OF THE INVENTION

The present invention relates to a peristaltic pump, in particular a multiplex planar peristaltic pump. The invention also concerns a rotor and a stator for such a pump.

BACKGROUND OF THE INVENTION

A peristaltic pump (also sometimes referred to as a roller pump) is a type of positive displacement pump used for pumping fluids, the fluid contained within a flexible tube mounted in a pump casing or stator.

In a typical peristaltic pump, a rotor carries a number of circumferential rollers mounted on bearings, each of which is arranged to compress the flexible tube. As the rotor rotates, a part of the tube is compressed by a roller, thus occluding the tube and forcing the fluid to move through the tube in the direction of movement of the roller. The tube is fabricated from a resilient material and thus reassumes its normal calibre after the compression by the roller ceases. This process of peristalsis mimics many biological systems (such as the action of oesophagus or the gastrointestinal tract). A body of fluid (or bolus) trapped between two successive rollers is thus transported at ambient pressure toward the pump outlet.

Typically, peristaltic pumps are employed in the pumping of clean or sterile fluids, as there is no contact between the pump mechanism and the content of the tube. Such pumps are often used in medical applications, such as to pump IV fluids through infusion devices, in haemodialysis systems, or in heart-lung machines to circulate blood during bypass surgery. Peristaltic pumps are also used to pump aggressive fluids and chemicals, including very viscous fluids and high solids slurries, where isolation of the material from the environment is important.

Peristaltic pumps may run continuously, or they may be indexed through partial revolutions to deliver smaller amounts of fluid. Aside from the benefits mentioned above, peristaltic pumps offer the advantages of low maintenance, few moving parts, prevention of backflow and siphon, and accurate dosing (as a fixed amount of fluid is pumped per rotation of the rotor). This latter characteristic (the ability to provide a flow rate directly proportional to the driving peristaltic motion) means that the pump can faithfully produce a predefined flow rate without the need for feedback-control by costly flow sensors. Further, as an in-line pump, a peristaltic pump affords the ability to change fluid medium without disrupting flow (unlike pressure driven pumping solutions such as syringe systems or pneumatic pumps). This means that various operations can be performed on the content of a receiving reservoir in real time, e.g. medium top-up, drug addition, gas equilibration, etc.

Peristaltic pumps have also been adopted in biological and biochemical analytical workflows for various purposes including transferring of fluids, washing and perfusion. One key application of peristaltic pump is in in-vitro perfusion of biological samples.

A number of commercial peristaltic pumps are available on the market. The target flow rate range is usually in the range of (at the minimum) mL/min, primarily useful in tissue-scale/organ-scale continuous perfusion or transient flushing/rinsing of smaller samples. Such pumps use flexible tubing as the fluid carrier, which tends to degrade with time due to abrasion.

An alternative to the conventional circumferential roller peristaltic pump is the planar peristaltic pump. This takes the form of a thrust ball bearing assembly, consisting of a rotor disc carrying a ring of stainless steel balls, as illustrated in FIG. 1. The rotor 1 is rotated at a particular angular velocity, and the balls are carried in a planar cage disc 3 which provides the required support and spacing. A soft substrate surface layer 2 on rotor 1 provides the friction required to rotate the balls 4, which are arranged to compress and roll on a silicon rubber substrate in which a fluid channel 6 is embedded. Stationary support disc or stator 7 underlies fluid channel 6 and substrate 5. The separation between rotor 1 and stator 7 is arranged such that the compression force exerted by balls 4 occludes fluid channel 6. As roller 1 rotates, all of the balls 4 are rolled in unison, resulting in the fluid trapped in the channel between two adjacent balls 4 being pushed forward. As will be understood, if the velocity of rotor 1 is v, cage disc 3 rotates at v/2, and the only sliding friction in the mechanism is that sustained between balls 4 and cage disc 3.

Examples of concepts around the planar peristaltic pump include the disclosure of US patent application no. 2014/0356849 (Vanderbilt University), US patent application no. 2018/0058438 (Novartis AG), US patent application no. 2018/0209552 (Vanderbilt University), European patent application no. 1,662,142 (Debiotech S. A.), US patent application no. 2018/0149152 (Takasago Electric, Inc) and international patent publication WO 2012/048261 (Vanderbilt University).

Planar peristaltic pumps allow smaller flows to be accommodated, and recent developments in this field include the 'on-chip pump', referring to a rotary planar peristaltic micropump fabricated in an elastomeric material such as polydimethylsiloxane (PDMS) by soft lithography, suitable for microfluidic integration. In such a microfluidic device the tubing is a microchannel embedded into or beneath a planar membrane. Such devices can provide a very consistent, continuous, controllable flow rate at the nL-μL/min scale.

With perfusion of biological samples, parallel flow of multiple samples is generally required. While multiple pumps can be used for this, developments in multiplexing have included stacking peristaltic pumps into a single assembly, providing multiple independent channels each operated by rotation of a rotor turned by a common shaft or by concentric shafts. Examples include the disclosures of U.S. Pat. No. 9,504,784 (Cole-Parmer Instrument Company LLC) and US patent application no. 2009/0035165 (Agilent Technologies Inc.).

Despite these advances, multiplexing capacity remains very limited, creating operational limitations particularly in clinical and laboratory environments.

Reference to any prior art in the specification is not an acknowledgment or suggestion that this prior art forms part of the common general knowledge in any jurisdiction or that this prior art could reasonably be expected to be understood, regarded as relevant, and/or combined with other pieces of prior art by a skilled person in the art.

SUMMARY OF THE INVENTION

In one aspect, the invention provides a rotor for a peristaltic pump, the rotor comprising a body for rotation about an axis, the body having a first side and a second side, the body supporting a plurality of spaced first rollers extending from the body on the first side, the first rollers positioned at a first common radius from the axis, the body further supporting a plurality of spaced second rollers extending from the body on the second side, the second rollers positioned at a second common radius from the axis.

When used in a peristaltic pump, the first and second rollers are thus able to apply force substantially in the axial direction (ie. in a direction normal to first and second sides of the rotor body) simultaneously onto adjacent surfaces positioned on both sides of the body, thus increasing the pumping capacity of a single rotor.

Preferably, the first rollers are arranged to contact the second rollers within the body.

In a preferred form, the spacing between the plurality of first rollers is substantially the same as that between the plurality of second rollers, the first common radius is substantially equal to the second common radius, the position of the plurality of first rollers is phase shifted with respect to that of the plurality of second rollers, each of the plurality of first rollers is arranged to contact two of the plurality of second rollers, and each of the plurality of second rollers is arranged to contact two of the plurality of first rollers.

With this arrangement, when used in a peristaltic pump, the first rollers and the second rollers roll against one another, with forces in the axial direction carried by the rolling contact of the surfaces of the rollers against each other, rather than by sliding contact between the rollers and the rotor body.

The rotor body may have a generally planar form and be provided with recesses in the first and second side to receive the first and second rollers respectively, the recesses meeting within the body to allow contact between the first and second rollers.

Alternatively, the body may comprise two planar parts, a first rotor part providing the first side of the rotor and a second rotor part providing the second side of the rotor, the first and second rotor parts being mutually engageable to retain the first and the second rollers between them, each of the first and second rotor parts having a plurality of apertures sized to allow the first and second rollers to extend therethrough while remaining captive between the first and the second roller parts, wherein the engagement between the first and the second roller parts provides that the plurality of apertures in the first roller part is out of phase with the plurality of apertures in the second roller part.

In one form, the rotor includes a further plurality of spaced first rollers extending from the body on the first side, the further plurality of spaced first rollers positioned at a third common radius from the axis different from said first common radius, additionally including a further plurality of spaced second rollers extending from the body on the second side, the further plurality of spaced second rollers positioned at a fourth common radius from the axis different from said second common radius.

In this way, the rollers may be arranged in multiple concentric rings, allowing peristaltic pumping in multiple fluid channels disposed in a similar concentric arrangement.

Preferably, the spacing between the further plurality of first rollers is substantially the same as that between the further plurality of second rollers, the third common radius is substantially equal to the fourth common radius, the position of the further plurality of first rollers is phase shifted with respect to that of the further plurality of second rollers, each of the further plurality of first rollers is arranged to contact two of the further plurality of second rollers, and each of the further plurality of second rollers is arranged to contact two of the further plurality of first rollers.

In accordance with this feature, the multiple concentric rings of rollers on one side of the rotor body are repeated on the other side, the rotor thus carrying multiple sets of mutually opposed offset rings of spaced rollers. This affords a very low wear arrangement, with a high multiplexing capacity.

In a further aspect, the invention provides a peristaltic pumping unit comprising the above-defined rotor assembled with a first stator and a second stator, the first stator having one or more compressible fluid channels arranged to be compressed by said first rollers and the second stator having one or more compressible fluid channels arranged to be compressed by said second rollers.

Preferably, the rotor body has a generally planar form and the first and second stators each has a planar surface on or in which the one or more compressible fluid channels are provided, wherein the rotor body is sandwiched between the first and second stators. Preferably this is done in a way to provide substantially the same compression on the one or more fluid channels of the first stator as that on the one or more fluid channels of the second stator.

In a preferred form, the pumping unit includes an adjuster mechanism to tune the separation between the first and second stators in order to adjust the compression on the one or more fluid channels.

Such adjustment allows the fluid channels to be occluded by the rollers of the rotor to the extent required to ensure desired pumping performance.

The first stator may include multiple fluid channels, each of which includes an arcuate portion at or substantially at said first common radius from the axis.

This allows the spaced first rollers to act on more than one fluid channel.

Preferably, the arcuate portion is of a length greater than the spacing between the spaced first rollers, such that the arcuate portion is simultaneously compressed by at least two rollers of said plurality of first rollers.

This feature enhances the pumping function, both in terms of uniformity of flow and in terms of robustness and tolerance.

In one form, the first stator may be at least partly formed by a compressible material forming a substantially planar surface and compressible arcuate portions of multiple fluid channels at different radii, each fluid channel arranged to be compressed by a different plurality of rollers to drive flow in that fluid channel, the stator including one or more recesses in the compressible material shaped and positioned to relieve compression of a particular fluid channel by passage of rollers not in the plurality of rollers arranged to drive fluid flow in that particular fluid channel.

In a further aspect, the invention provides a peristaltic pumping assembly, comprising a plurality of the above-defined peristaltic pumping units, stacked to align the axis of each rotor, including a drive shaft configured to engage and rotate each rotor.

Hence a common shaft can be used to drive a plurality of similar pumping units, multiplying the pumping capacity significantly.

In a further aspect, the invention provides a stator for a peristaltic pump, having a body with a planar surface and two or more fluid channels, each fluid channel having a compressible arcuate portion on or in the planar surface of the stator, the arcuate portions arranged to be compressed by a plurality of rollers mounted on a rotor, one or each of the arcuate portions connecting to further portions of the fluid channel extending in a direction away from the planar surface such that one or more of the fluid channels take a three dimensional path within the body of the stator.

In accordance with this aspect, one or each fluid channel follows a three dimensional path within the stator body, different parts of a single channel disposed in different axial planes (ie. at different depths below the planar surface). This allows a wide variety of different configurations of fluid channels to be used, including concentric fluid channel arrangements, while avoiding interference between channels. Flow paths can effectively interweave and overlap by use of the different planes, allowing great flexibility in regard to fluid channel configuration and positioning of inlet and outlet ports for the channels.

In one form, the body comprises two layers, namely a surface layer made of a compressible material and formed to provide said planar surface and said compressible arcuate portions of the two or more fluid channels and an underlying support layer bonded to said surface layer, the support layer made of a relatively incompressible material in which said further portions of the fluid channels are provided.

The compressible arcuate portions of the two or more fluid channels may be made by a process of soft lithography applied to the surface layer.

In one form, said further portions of the two or more fluid channels each connect to an inlet or exit portion of the fluid channel, the inlet or exit portion extending in a radial direction, wherein the body comprises a third layer underlying and bonded to said support layer, said third layer formed to provide said inlet or exit portions.

The inlet or exit portion of each of the two or more fluid channels may be made by a suitable machining process applied to the third layer. This could be (for example) a process of soft lithography (suitable if the third layer is a compressible elastomeric material) or micro-milling (suitable if the third layer is a more rigid material).

In one form, two of said two or more fluid channels are parallel channels which connect together to provide a common channel inflow and a common channel outflow, the compressible arcuate portions of said two parallel channels arranged to be compressed by the rollers of said plurality of rollers in an out-of-phase timing, in order to reduce the pulsatile nature of the common channel outflow.

Preferably, the compressible arcuate portions of the two parallel channels have a substantially common radius, such that they can be compressed by a plurality of spaced rollers positioned at a common radius from an axis of rotation of said rotor.

In one form of the stator, a first and a second arcuate portion of, respectively, a first and second of said two or more of the fluid compressible fluid channels are at different radii on the stator, the first arcuate portion arranged to be compressed by a first plurality of rollers to drive flow in said first fluid channel, the second arcuate portion arranged to be compressed by a second plurality of rollers to drive flow in said second fluid channel, the stator body including one or more recesses interrupting the planar surface, shaped and positioned to relieve compression of the first fluid channel by passage of the plurality of rollers which are arranged to drive fluid flow in the second fluid channel.

In a further aspect, the invention provides a peristaltic pumping unit comprising the above-defined stator assembled with a rotor, the rotor supporting or driving a plurality of rollers, the rollers positioned to compress the arcuate portions of said two or more compressible fluid channels.

The present invention therefore provides a rotary planar multiplexed microfluidic pump. Using a single control motor, the invention allows multiplexing the pumping capability for a large number of separate parallel lines. This has particular application in a continuous perfusion setup for multiple biological samples, such as culturing media.

BRIEF DESCRIPTION OF THE DRAWINGS

Further aspects and advantages of the present invention and further embodiments of the aspects described in the preceding paragraphs will become apparent from the following description, given by way of example and with reference to the accompanying drawings.

DETAILED DESCRIPTION OF THE EMBODIMENTS

Figure 1:
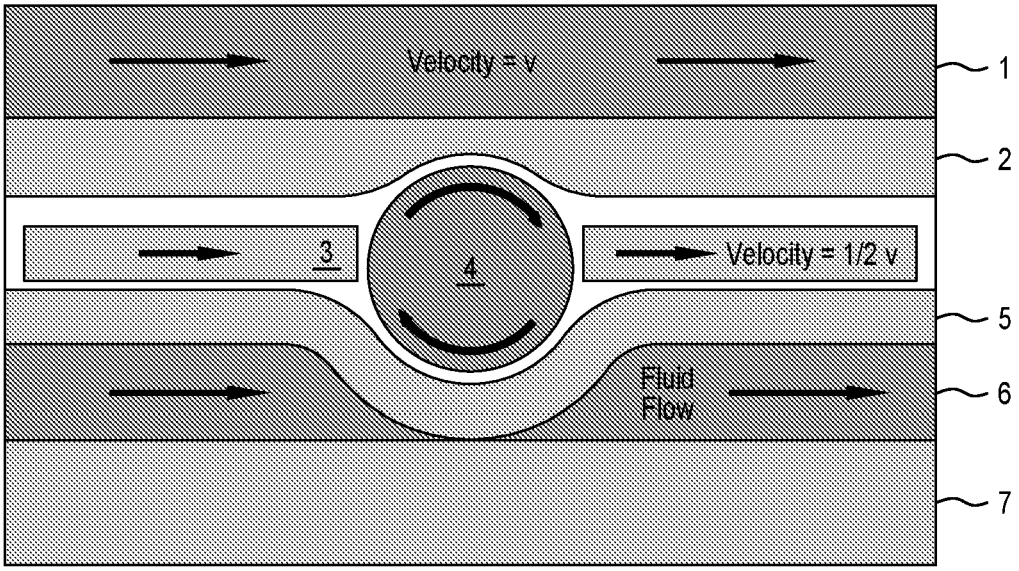
FIG. 1 diagrammatically illustrates in side view a planar peristaltic pump according to the prior art.
Figure 2:
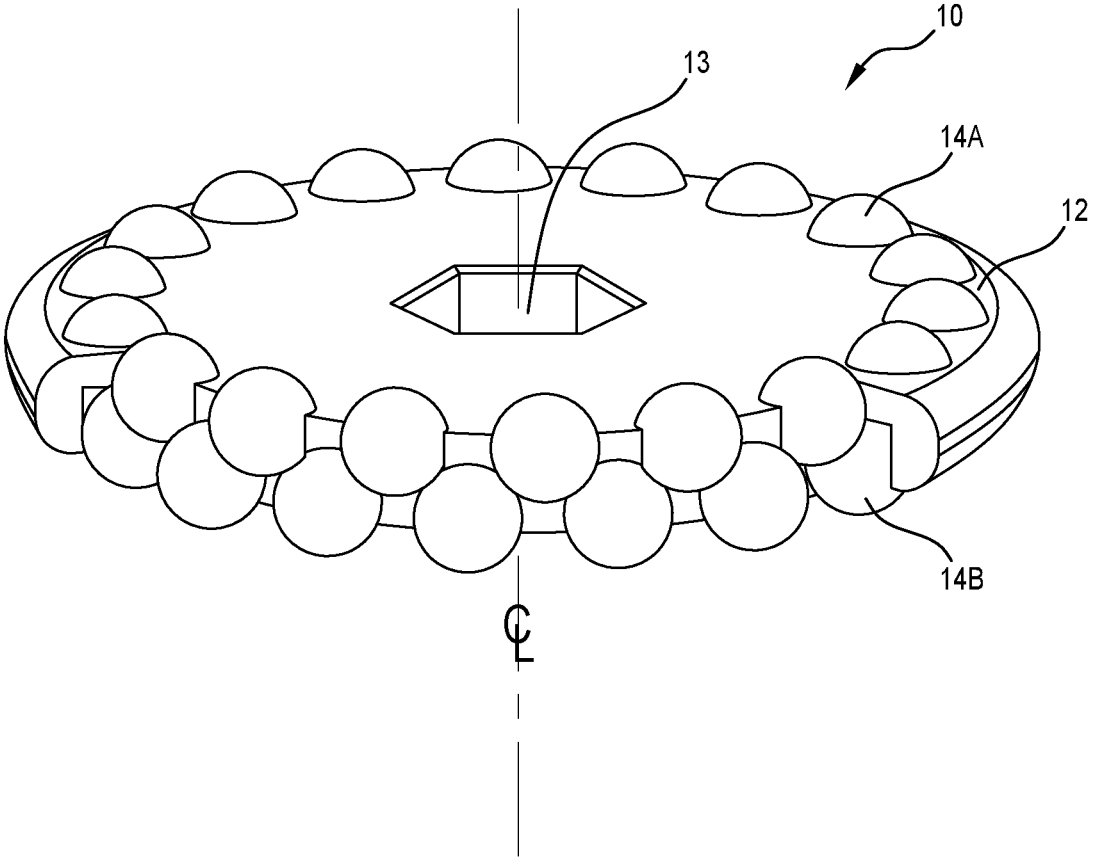
FIG. 2 shows in perspective view a dual ring roller ball rotor in accordance with the present invention, depicted in partial cutaway view to illustrate the roller balls contained in their respective rotor recesses.

The dual ring roller ball rotor 10 of FIG. 2 provides a multiplex pump driver. A planar rotor disc 12 with a central hex rotational drive shaft aperture 13 includes a succession of shaped recesses on both sides as shown, arranged to hold an upper ring of evenly spaced roller balls 14A and a lower ring of evenly spaced identical roller balls 14B. Both rings of balls 14A and 14B are at the same radius from the axial centreline, and sized and mounted to project a prescribed distance above and below, respectively, from the upper and lower faces of the disc 12.

Figure 3:
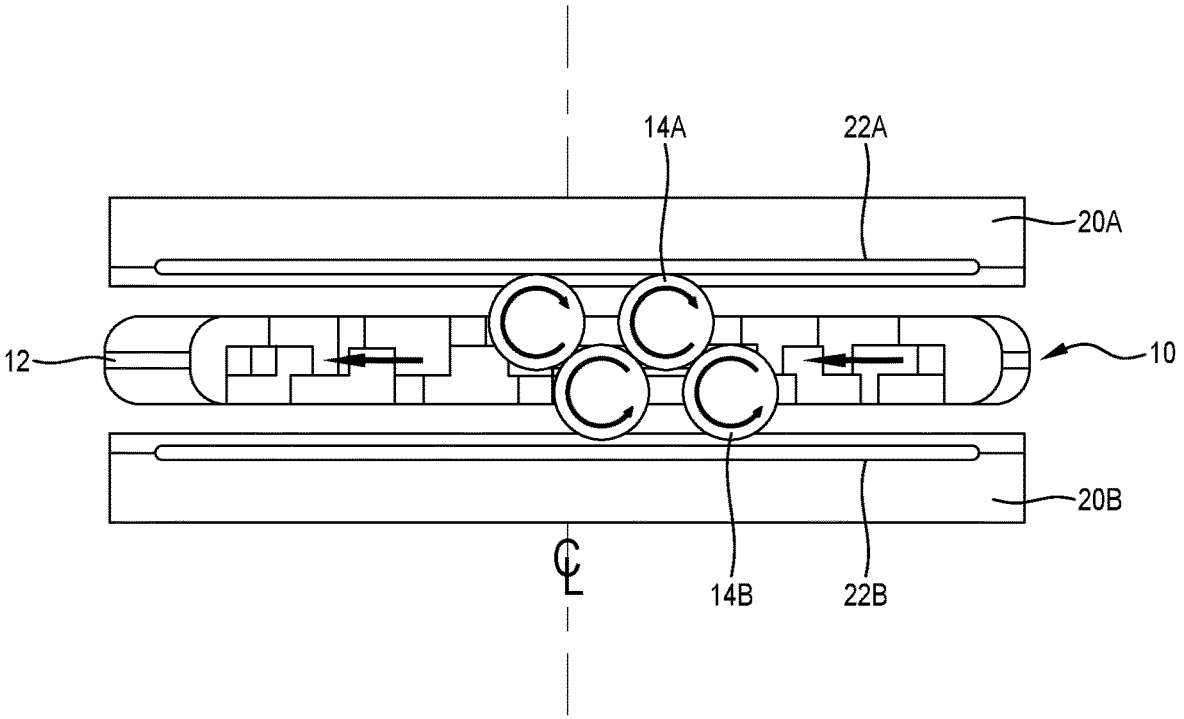
FIG. 3 shows in side view the rotor of FIG. 2 in a pumping unit including upper and lower fluid channel stator discs.

As FIG. 3 illustrates more clearly, the positioning of the succession of roller balls 14A is phase shifted with respect to that of roller balls 14B, with each ball 14A mounted to contact two successive balls 14B (and vice versa). This is achieved by arranging the upper ring of recesses with an angular offset from the lower ring (so that the angular position of each ball 14A is intermediate of that of two successive balls 14B), with the recesses intersecting to allow the roller balls from the two different sides be in contact with each other.

FIG. 3 also shows two channel stator discs arranged parallel to rotor 10, namely an upper channel stator disc 20A and a lower channel stator disc 20B. Embedded within the resilient surfaces of stator discs 20A and 20B are upper fluid channel 22A and lower fluid channel 22B respectively, each fluid channel positioned close to the face of the channel stator disc which is adjacent rotor disc 12. Further detail regarding the embedded fluid channels 22A and 22B is provided below.

Channel stator discs 20A and 20B are arranged such that the resilient surfaces of, respectively, their lower and upper faces are compressed by balls 14A and 14B, so to occlude fluid channels 22A and 22B.

The operation of the pumping unit (provided by rotor 10 sandwiched between the stator discs 20A and 20B), is as follows. When rotor 10 is rotated in a clockwise direction (when viewed from above in FIG. 3), due to the high friction surface of stator disc 20A roller balls 14A rotate in a clockwise direction, while roller balls 14B rotate in an anticlockwise direction. Hence, where they are contiguous, roller balls 14A and 14B rotate in opposite directions at the same speed, resulting in them rolling against one another with no sliding friction. The only sliding friction in the mechanism is at the points where balls 14A, 14B contact the surfaces of the recesses in rotor disc 12, and since the forces on the roller balls are only in the axially aligned direction (and thus carried by other roller balls), this sliding friction (and therefore the wear) is minimal.

The rolling compression of the surfaces of channel stator discs 20A and 20B results in peristaltic occlusion of both fluid channels 22A and 22B, providing parallel fluid flow from a single pump drive.

Figure 4:
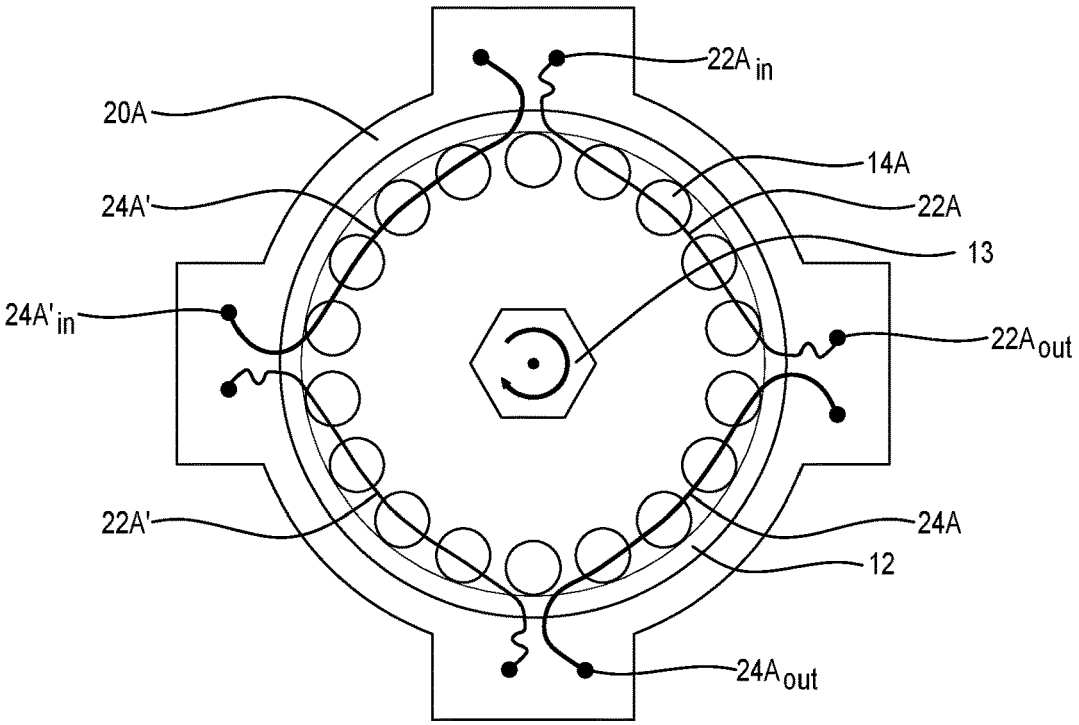
FIG. 4 shows in plan view detail of the pumpting unit of FIG. 3.

As FIG. 4 illustrates, to further boost the multiplexing capability of the pumping unit, multiple fluid channels (in this example, four) are provided in each channel stator disc 20A, 20B, increasing to eight the number of fluid channels operated by a single rotor 10. More fluid channels can be used (minimising channel length to accommodate the maximum number of fluid channels on each stator channel stator disc). Although not essential, ideally there should always be more than two balls fully occluding each fluid channel at any point of time, in order to provide an adequate channel sealing for the most effective pumping at ambient pressure.

For illustration purposes, FIG. 4 shows in plan view upper channel stator disc 20A bearing on rotor 10. At least a part of each fluid channel takes a substantially arcuate course, arranged and positioned in such a way that it can be fully occluded by at least two roller balls 14A. Fluid channel 22A connects an inlet port 22$A_{in}$ to an outlet port 22$A_{in}$, positioned towards the periphery of channel stator disc 20A as shown. Diametrically opposed to fluid channel 22A is a similar fluid channel 22A' connecting an inlet port 22$A'_{IN}$ to an outlet port 22$A'_{out}$. Intermediate these two fluid channels and mutually diametrically opposed are fluid channels 24A and 24A', which are identical but (in this example) of twice the cross sectional area (bore) of fluid channels 22A, 22A'.

As rotor 10 rotates in the clockwise direction, fluid entering at ports 22$A_{in}$, etc. is peristaltically pumped by roller balls 14A along the fluid channels to exit at outlet ports 22$A_{out}$, etc. While the flow in fluid channel 22A is equal to that in fluid channel 22A', twice that flow is pumped through fluid channels 24A and 24A'. As will be understood, the 2:1 bore ratio of fluid channels 24A/24A' to 22A/22A' is merely illustrative. The bore of each fluid channel can of course be selected to provide the desired fluid flow in that channel at a given RPM of rotor 10.

Each channel stator disc 20A, 20B is constructed of two layers of PDMS material, the fine fluid channels 22A etc. formed by soft lithography (as generally known and as discussed above). Such a microchannel has a cross sectional form that is approximately rectangular and is formed in the surface of one or both of the layers of PDMS material, those surfaces bonded together to encapsulate the channel. The face layer of PDMS is a relatively thin membrane layer, to afford ready compression by the roller balls, while the base layer is a thicker substrate layer. As will be understood, the base layer may be fabricated from a less resilient material (eg. a synthetic resin such as polymethyl methacrylate, PMMA).

It will be understood that other geometries and fabrication techniques are equally possible. For example, rather than a rectangular section a microchannel may have a circular segment cross section, for example with the same or a similar radius to that of roller balls 14A, 14B. This form may be achieved by micro-machining a groove of semicircular section of the required diameter in a more resilient base layer (such as a PMMA base layer), the flexible PDMS face layer forming a planar overlay closing the groove to form the channel. When a roller ball compresses the microchannel it pushes the elastomeric membrane into the arcuate groove following its curvature, to occlude the channel. Further, it is not necessary to form the microchannels from the bonding of two separate elements. They may instead be machined into a material using a suitable microfabrication technique, such as casting, moulding, laser machining, 3D printing techniques, etc.

Figure 5:
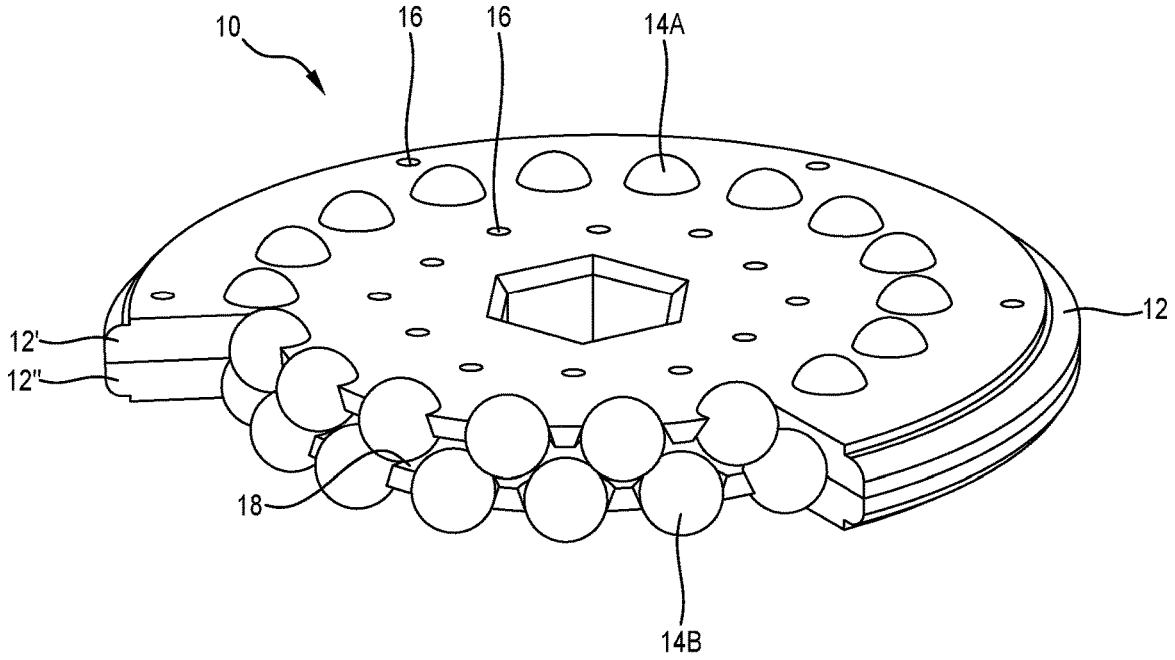
FIGS. 5 and 6 show in perspective view two alternative constructions of a rotor in accordance with the present invention.
Figure 6:
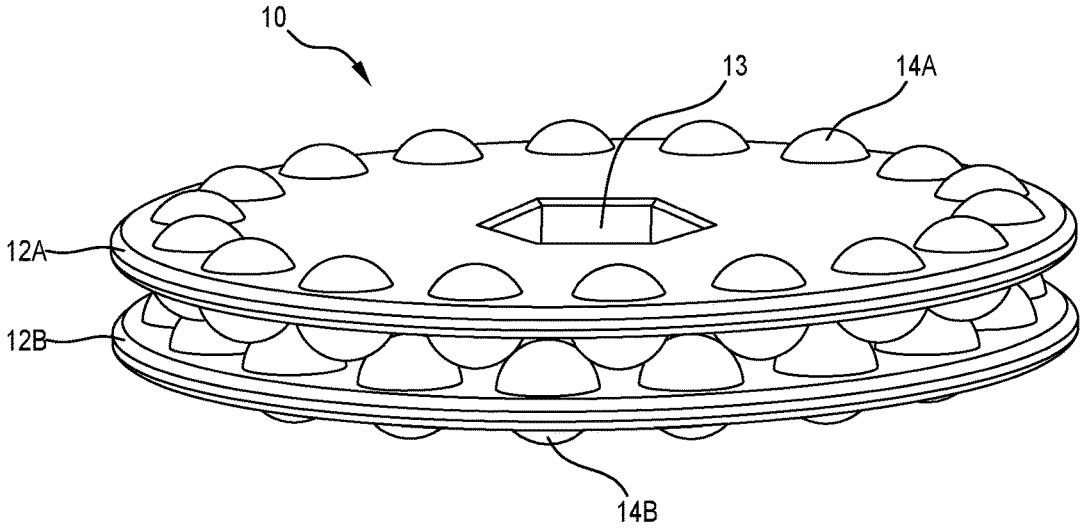

FIGS. 5 and 6 illustrate two alternative constructions of rotor 10. The construction in FIG. 5 is in many ways similar to that of FIG. 2, comprising a single rotor disc 12 with the roller balls meeting due to the interconnection of the succession of retaining recesses from each side of the disc. In this way, rotor disc 12 acts as a dual ring ball bearing cage. Roller balls 14A, 14B may be retained in their recesses solely by the compressive action of the respective surfaces of channel stator discs 20A and 20B (such that individual roller balls can be readily removed and replaced as required, eg. as a result of wear or rust), or the construction and sizing may be of a diameter that each roller ball can 'pop fit' into the interior of the recess. For example, rotor disc 12 may be made from a slightly pliable metal material, the balls able to 'pop fit' into the receiving recesses immediately after subjecting rotor disc 12 to heat expansion (similar to the processes used in ball bearing race assembly fabrication).

As can be seen from the cutaway part of the rotor 10 of FIG. 5, this construction comprises two generally disc shaped halves 12' and 12", each including a ring of shaped apertures to accommodate roller balls 14A, 14B, the halves 12' and 12" brought together and joined to define a central annular-shaped cavity in which roller balls 14A contact roller balls 14B. Additional elements 16 are included to connect (or reinforce the connection between) rotor halves 12' and 12", to maintain a uniform separation between their planar outer faces (and ensure the required separation between the centres of roller balls 14A and 14B). As the skilled reader will understand, such a two-part construction is not essential, and alternative fabrication methods may be used to produce such a structure.

The construction of FIG. 6 comprises an upper rotor disc part 12A and a lower rotor disc part 12B, united by a central boss portion (not fully visible) around drive shaft aperture 13. The interconnection is achieved in a manner that disposes the recesses in upper rotor disc part 12A to alternate in position with those of lower rotor disc part 12B. The roller balls 14A, 14B have a diameter larger than that of the recesses, and are placed in the recesses before parts 12A and 12B are united so that they are then held in place, rotor 10 becoming a single-piece component once assembly is complete.

Figure 7:
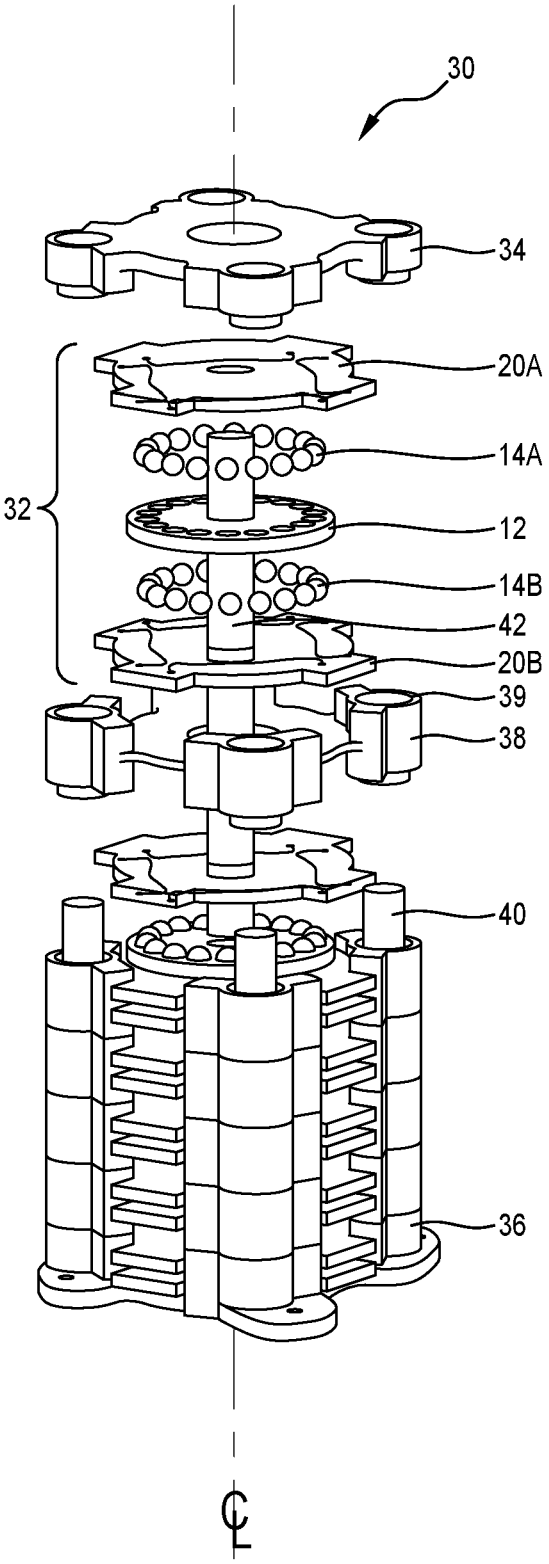
FIGS. 7 (exploded) and 7*a* illustrate a pumping assembly comprising a stack of the pumping units of FIG. 3.
Figure 7A:
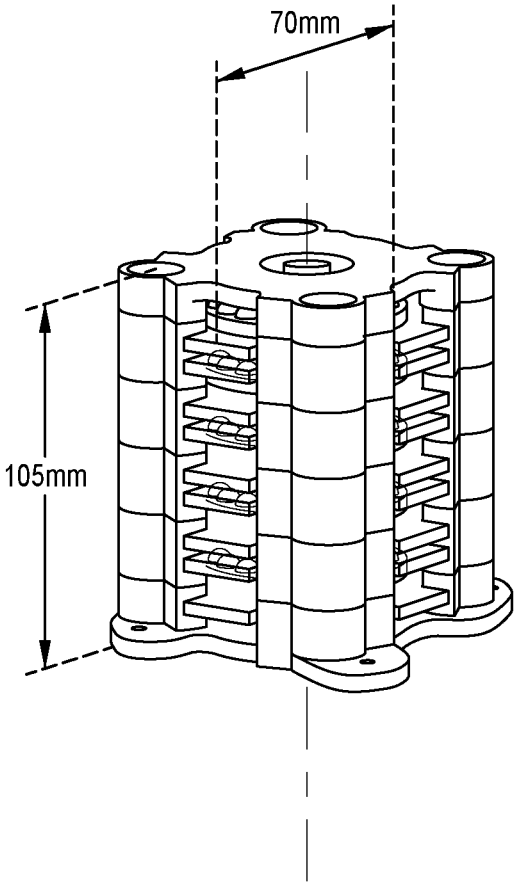

As shown in FIGS. 7 and 7*a*, multiples of the pumping unit described above are stacked to provide a multiplex pumping assembly 30, all driven by a single rotary hex shaft 42 sized to engage with the hex apertures 13 in rotor discs 12. In this example six pumping units (12 channel stator discs) are combined, boosting the multiplexing capability to 48 fluid channels in total.

As will be understood, hex shaft 42 engaging with hex apertures 13 is only one example way of applying rotational drive to rotor discs 12, and any suitable shaping or engagement can be used. Rotor disc 12 should preferably be able to move freely in the axial direction, so that the compressive force of roller balls 14A and 14B normal to the plane of rotor disc 12 (ie. in the axial direction) is distributed (and therefore applied evenly) between channel stator discs 20A and 20B.

Assembly 30 includes a closure plate part 34, a base support plate part 36, and five intermediate support plate parts 38, each of which parts 38 separates two pumping units. Plate parts 34, 36 and 38 each provide a planar support for respective channel stator discs 20A, 20B. Plate parts 34, 36 and 38 all have four corner stanchions 39 to mutually register all of the pumping units in angular orientation, each of corner stanchions 39 having an axially aligned aperture therethrough, allowing all the parts to be mechanically clamped together by means of screw rods 40 and end nuts (not shown).

As shown in FIG. 7, each intermediate support plate 38 has a central aperture of diameter larger than that of shaft 42. If desired, this aperture may be reduced and configured to provide a plurality of ring bearings for shaft 42, to maintain shaft 42 on the axial centreline (with shaft 42 redesigned to have a circular section, at least at the axial positions of the intermediate support plates 38). Alternatively or additionally, the circumference of rotors 12 may be increased to bear against the arcuate shaped inner surfaces of corner stanchions 39, so assisting in maintaining shaft 42 on the axial centreline and assisting the dynamic stability of the assembly.

In a prototype designed, built and tested by the inventors, rotor 10 comprised two rings of 18 evenly spaced stainless steel ball bearings each 5 mm in diameter mounted in recesses 3.2 mm in depth and 5.2 mm in diameter. Rotor disc 12 was 55 mm in diameter and 4.8 mm in thickness, with the roller ball rings mounted to follow a circular path 40 mm in diameter.

Ideally, rotor disc 12 is made from a material such as acetal resin. Such a material is low weight and fatigue resistant, displays low friction and wear, has high stiffness, strength and hardness and very good dimensional stability. Roller balls 14A, 14B are made from a suitable rigid material that rolls with minimum friction, such as stainless steel or a suitable glass or ceramic material.

The axial separation between channel stator discs 20A and 20B in each pump unit may be adjusted to provide a prescribed degree of compression on the stator disc by the roller balls, in order to fully occlude the fluid channel within. In the prototype tested, a compression of 750 μm in depth was generated, which was found to ensure effective occlusion of fluid channels of 80 μm in height and 500 and 800 μm in width (channel bore 0.04 and 0.064 $mm^2$, respectively). The fluid channels were formed in the surface of a PDMS base layer of 2.7 mm thickness, the channels then closed by oxygen plasma bonding of a 500 μm thick PDMS face layer to the PDMS base layer.

The dimensions provided in FIG. 7*a* show the height and width of the prototype six-stage multiplex pump assembly. This can be mounted to an OEM device arranged to drive the head of shaft 42, or alternatively engaged with a custom motor driver.

Figure 8A:
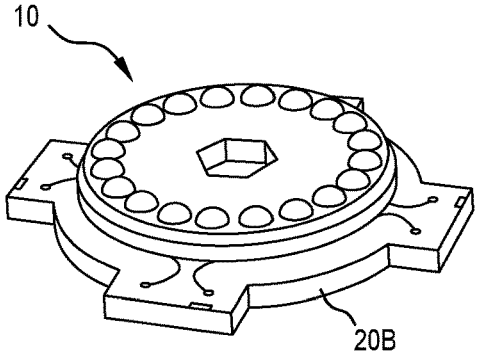
FIG. 8 illustrates variants of fluid channel stator discs.
Figure 8C:
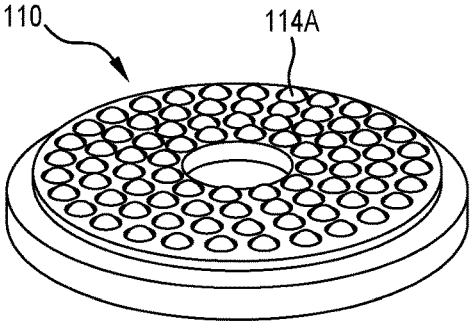

For yet a further increase in multiplexing capacity, the number of rings of roller balls 14A, 14B may be increased. This modification is illustrated in FIG. 8*c* (compare FIG. 8*a*), which shows four concentric rings of roller balls 114A on the upper side of rotor 110 (the arrangement replicated on the lower side).

Figure 8B:
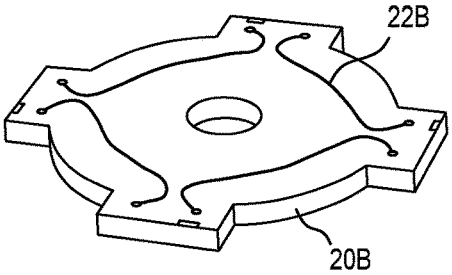
Figure 8D:
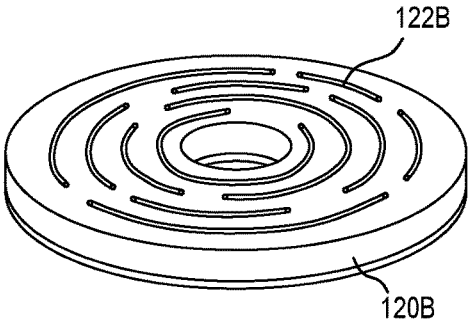

Such an arrangement necessitates a revised design of the channel stator discs as shown in FIG. 8*d* (compare FIG. 8*b*), in which lower channel stator disc 120B is provided with multiple fluid channels (122B, etc.) at four different radii, corresponding to the radii of the four rings of roller balls 114B. As will be understood, the flow rates across the concentric peristaltic channels must be calibrated, as they experience peristaltic motions of different speeds. If equal flow rates are required, suitable selection of fluid channel bores is necessary.

In this example a total of 11 channels are shown; using this design of stator disc in a six-stage multiplex pumping assembly 30 of the type shown in FIG. 7 will therefore provide a multiplexing capability of 132 fluid channels.

Figure 8E:
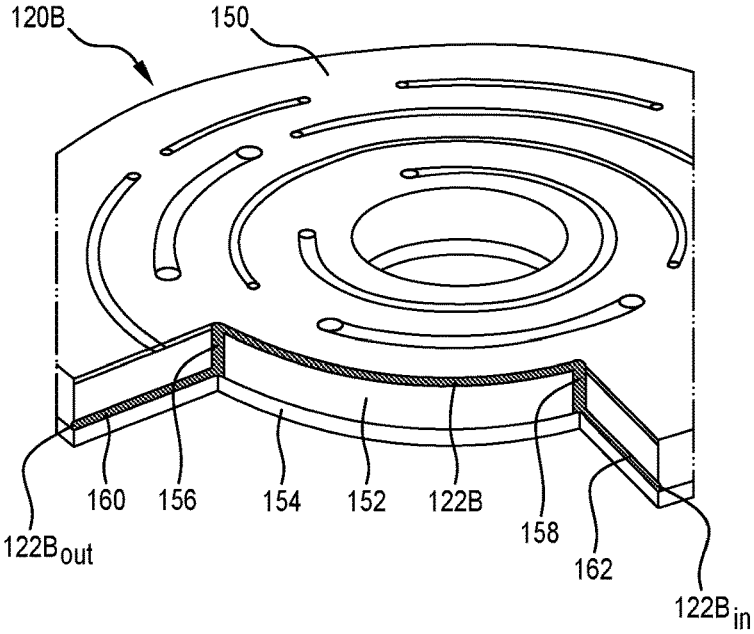

This type of channel arrangement is shown in further detail in FIG. 8*e*, in which the multiple arcuate fluid channels of lower channel stator disc 120B can be seen. As will be appreciated, in this form the fluid channels can potentially interfere with one another, as connection of a radially inner fluid channel with its peripheral inlet or outlet will involve crossing the radius of another fluid channel. Whilst this can be done by arranging the radially directed inlet and outlet channel portions in spaces between the arcuate tracks of other channels, this could potentially limit the usefulness of this solution. In addition, the roller balls of an outer ring of balls will intermittently occlude those radially directed inlet and outlet channel portions, so interfering with the pumping action and affecting performance (see further discussion below concerning coplanar channel arrangements).

As the cutaway view of FIG. 8*e* shows, the solution of the present invention involves the fluid channels following a three-dimensional course. To this purpose, channel stator disc 120B comprises three layers, a surface PDMS layer 150, a relatively rigid support layer 152 formed of a synthetic resin and a base PDMS layer 154. Fluid channel 122B includes an arcuate portion for peristaltic operation (similar to the arcuate fluid channel portion of FIGS. 4 and 8*b*), connecting at each end with an axially aligned outflow and inflow portion 156, 158, the ends of which connect respectively with radially aligned outflow and inflow portions 160, 162, which terminate respectively in ports $122B_{out}$ and $122B_{in}$.

Axially aligned fluid channel portions 156, 158 are formed in support layer 152 by appropriate micro-machining, while radially aligned portions 160, 162 are formed by soft lithography in the surface of base PDMS layer 154, before base PDMS layer 154 is bonded to support layer 152.

As will be understood, different parts of the fluid channels are located in different planes of the stator disc, the use of multiple planes allowing channel crossing and overlapping, hence enabling the concentric multiple channel arrangement. The relatively rigid nature of support layer 152 means that axially aligned channel portions 156, 158 are not compressed (which could otherwise interfere with the pumping operation), and also prevents the localised pressure of roller balls being transferred through the stator disc (which might otherwise partially occlude channel portions 160, 162).

Ideally, compression of radially aligned channel portions 160, 162 should be avoided. With this in mind, base layer 154 need not be made from an elastomeric material, but can comprise a more rigid material such as PMMA, the channels formed by micro-milling or other suitable machining technique.

Figure 9:
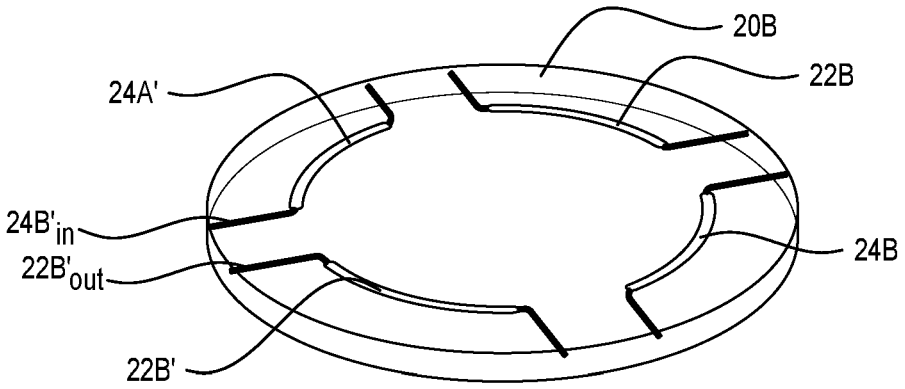
FIGS. 9 and 10 illustrate different configurations of fluid channel systems embedded within fluid channel stator discs.
Figure 10:
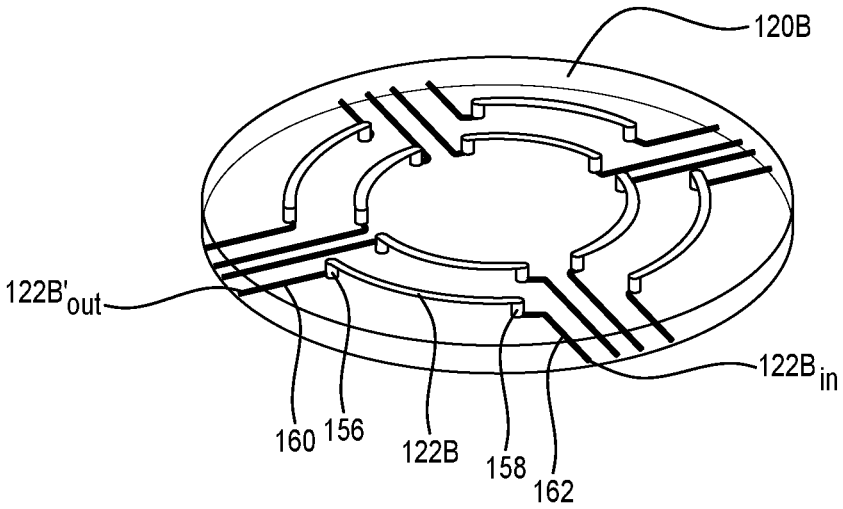

The different configurations of fluid channels are illustrated further in the examples of FIG. 9 (two-layer stator construction, single plane of fluid channels) and FIG. 10 (three-layer stator construction, two planes of fluid channels). As will be noted in FIG. 10, the multiple plane solution allows great flexibility in positioning of inlet and outlet ports, thus affording superior tubing management for connecting the pump assembly.

For the multiplane fluid channel solution depicted in FIGS. 8*e* and 10, channel portions 156, 158, 160 and 162 have an approximately square cross section (in contrast to the 5:1 aspect ratio of the cross section of the surface arcuate portions), in order to minimise any occlusion that might otherwise be produced by the moving roller balls.

Figure 11A:
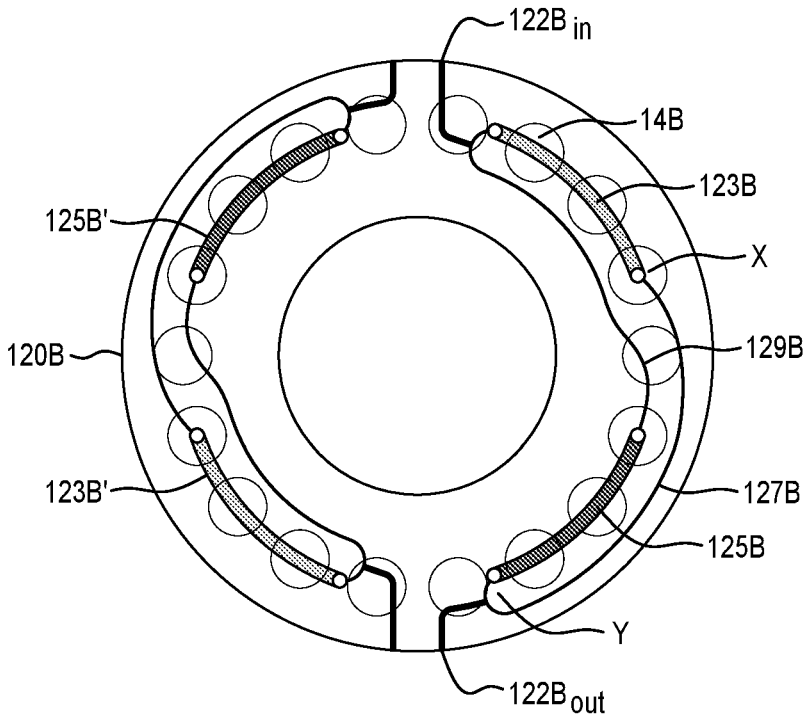
FIGS. 11 and 12 illustrate a further configuration of a fluid channel system embedded within a channel stator disc, including a resulting output flow pattern.
Figure 11B:
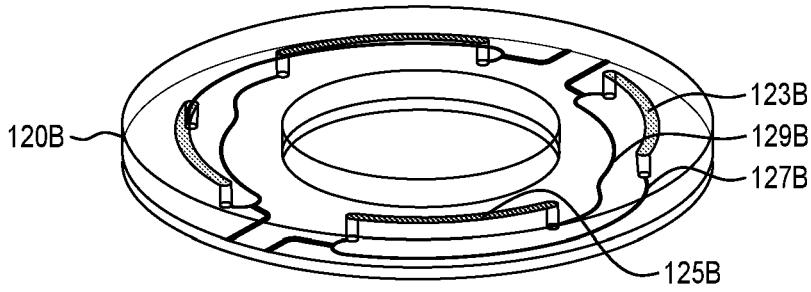

The embodiment shown in FIGS. 11*a* and 11*b* uses a multiplane channel design to produce a more stable flow profile, reducing the effect of the pulsatile nature of peristaltic pumping. In this embodiment, fluid channel 122 splits between input 122$B_{in}$ and output 122$B_{out}$ into two parallel channels, each having an arcuate portion 123B and 125B in a first plane near the surface of channel stator disc 120B, arcuate portions 123B and 125B both at the same radius from the axial centreline (the radius of the ring of roller balls 14B), thus arranged for peristaltic operation (similar to the arcuate fluid channel portion of FIGS. 4 and 8*b*). Forming the outer of the two parallel channels, arcuate fluid channel portion 123B connects to a downstream portion 127B in a second plane within the body of channel stator disc 120B, while in the inner of the two parallel channels, a channel portion 129B disposed in the second plane connects to downstream arcuate fluid channel portion 125B. The three-dimensional arrangement of the channels is more clearly shown in FIG. 11*a*, repeated in a diametrically opposed channel system as shown (including arcuate fluid channel portions 123B' and 125B' arranged for peristaltic operation).

The particular channel configuration is arranged such that the two parallel channels are compressed by roller balls 14B at a half-pitch phase shift (as can be seen by a roller ball occluding the end point of arcuate portion 123B at position X, while another roller ball occludes the inner channel at a point a half pitch from the end point Y of arcuate portion 125B). In this way, the pulsatile flow profiles generated by the two parallel channels are in antiphase, the combination being a stabilised net flow. As will be understood, the phase shift does not have to be an antiphase arrangement, alternative out-of-phase arrangements may be employed.

Figure 12:
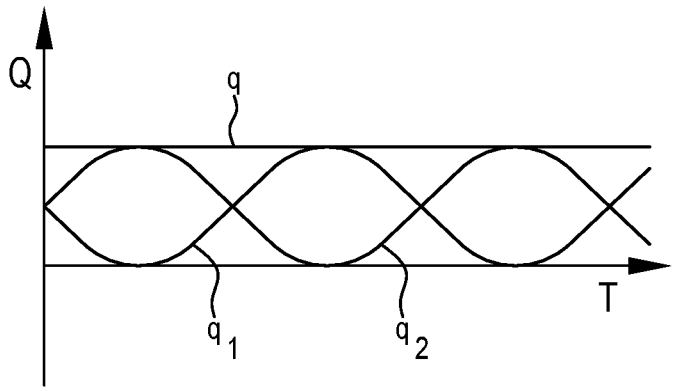

The effect of this offset pump configuration is illustrated in the flow profile of FIG. 12, showing flow Q against time T. Pulsatile flow $q_1$ resulting from the peristaltic action on arcuate portion 123B and pulsatile flow $q_2$ resulting from the peristaltic action on arcuate portion 125B have out-of-phase pulse patterns, combining to produce a net even flow q at single stream output 122$B_{out}$. This out-of-phase parallel channel occlusion operation has the advantageous effect of significantly reducing pulsation.

The designs discussed above concerning channel stator discs with multiple fluid channels at different radii (see the embodiments of FIGS. 8*d* and 8*e*, for example), in which the radius of each fluid channel corresponding to that of a ring of roller balls 114B, can be modified to avoid or reduce the need for multi-planar fluid channels (ie. fluid channels that follow a three-dimensional path).

Figure 13A:
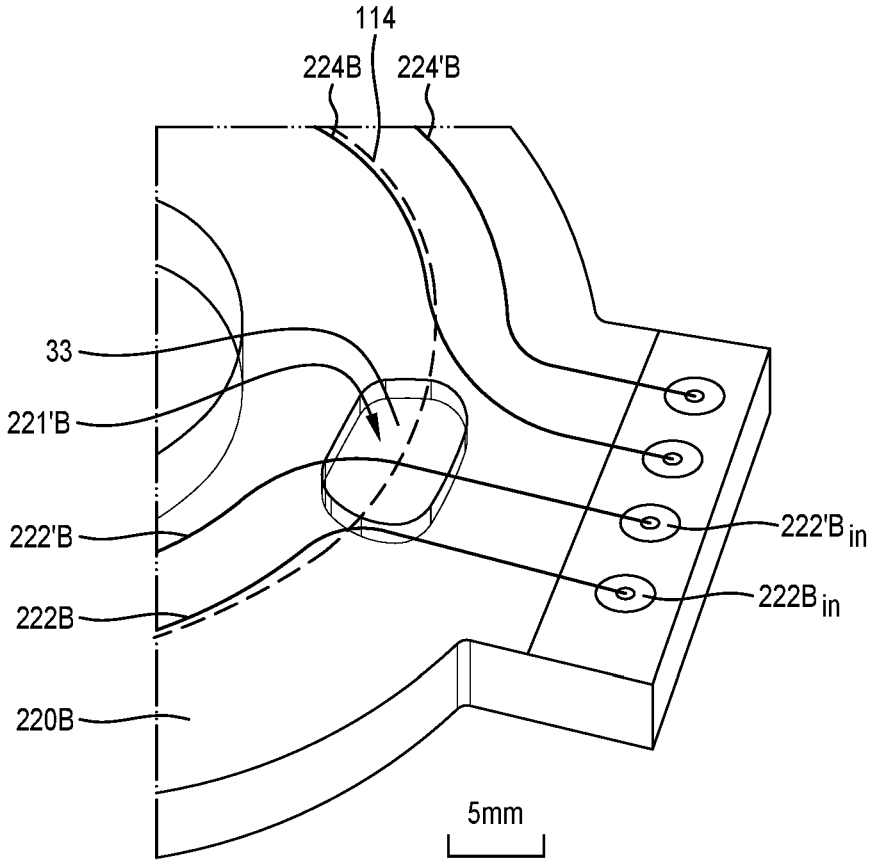
FIG. 13*a* depicts a variant of a channel stator disc to address flow disparities, with FIGS. 13*b* and 13*c* illustrating resulting flow characteristics.

FIG. 13*a* illustrates an example of a coplanar arrangement of stator fluid channels, of a construction type which could (for example) replace channel stator disc 120B illustrated in FIG. 8*d* and FIG. 10. Alternatively, the channel stator disc could feature a hybrid construction, with some fluid channels being mutually coplanar and others taking a three-dimensional path.

In FIG. 13*a* a number of coplanar fluid channels, 222B, 222'B, 224B, 224'B are arranged at various radii within the resilient surface of lower channel stator disc 220B. In a similar way to other embodiments discussed above, each fluid channel is positioned to allow engagement by a ring of roller balls arranged on a rotor at the same radius from rotor's centre of rotation, the roller balls exerting a compression force to drive peristaltic flow in the fluid channel.

As shown in FIG. 13*a*, roller ball path 114 depicts the movement of the ring of roller balls arranged to drive flow in channels 222B and 224B, with rings of roller balls at other radii driving flow in channels 222'B and 224'B. However, roller ball path 114 inconveniently intersects a 'non-pumping' portion 221'B of channel 222'B, this roller crossover inducing a brief fluidic path blockage at this point, which undesirably affects the flow generation of this channel. To mitigate this effect, a pocket recess 33 is provided in the surface material of lower channel stator disc 220B, sized and positioned relative to portion 221'B of channel 222'B so to allow downward displacement of the fluid channel as the roller balls pass thereover. This effectively avoids or minimises the deformation of stator disc 220B and the peristaltic occlusion of non-pumping segment 221'B.

In a prototype tested, a compression of 500 μm in depth was generated by the roller balls on lower channel stator disc 220B, in which fluid channels 222B, 222'B, 224B and 224'B of 75 μm thickness were embedded at a depth of 300 μm. The overall thickness of channel stator disc 220B was 2.8 mm, locally reduced by pocket recess by 0.5 mm.

Figure 13B:
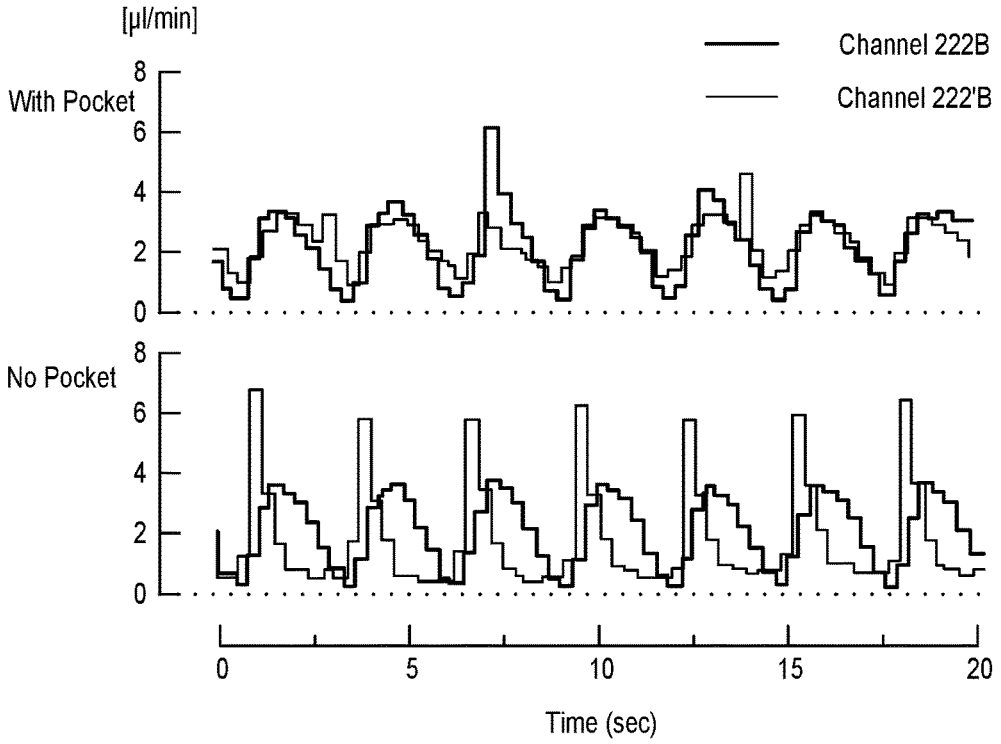

FIG. 13*b* shows the flow rate in channels 222B and 222'B measured with and without recess pocket 33 on stator disc 220B. It can be seen that incorporation of pocket recess 33 substantially alleviated the impact of roller crossover on the flow rate profile, re-aligning it to the uninterrupted profile.

Figure 13C:
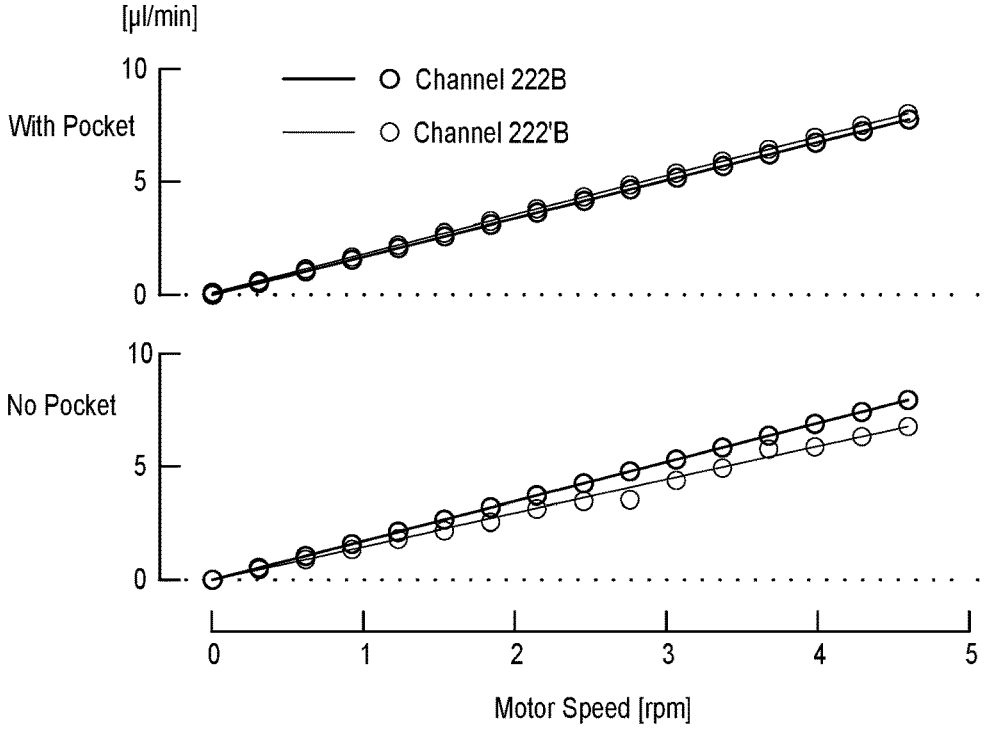

FIG. 13*c* compares the flow in channel 222'B against that in channel 222B across different rotor angular velocities, revealing a consistent reduction of 14.7±3.5% in average flow rate for stator disc structure without pocket recess, and a marginal 5.6±5.3% relative flow for a structure with pocket recess. This further supports the function of the pocket recess feature in flow rate maintenance for coplanar fluid channel arrangements.

As the skilled reader will appreciate, one or more pocket recesses may be provided as required for multiple fluid channels embedded within the resilient surfaces of both the upper and lower channel stator discs.

Additional or alternative measures can be included to provide channel equivalence, for instance reduction of the fluid channel cross-sectional aspect ratio at non-pumping channel portions. In this case, increase in channel thickness is preferred over decrease in channel width, to avoid undesirably raising the total flow resistance, which may otherwise limit the flow generation capacity.

In the embodiments described above and illustrated herewith, the peristaltic operation of the fluid channels is achieved using roller balls. However, it will be understood that cylindrical or other non-spherical (eg. tapered, barrel or needle) rollers may be used, two layers of such rollers arranged in the bearing cage provided by rotor disc 12.

Commercial uses of the present invention include any applications where parallel fluid flow (in particular, in the nL-μL/min range) is required, such as parallel flow perfusion for cell culture, including periodic or timed fluid transfer for multiple fluid lines.

It will be understood that the invention disclosed and defined in this specification extends to all alternative combinations of two or more of the individual features mentioned or evident from the text or drawings. All of these different combinations constitute various alternative aspects of the invention.

As used herein, the term 'comprise' and variations of the term, such as 'comprising', 'comprises' and 'comprised', are not intended to exclude further additions, components integers or steps.

The invention claimed is:

1. A rotor for a peristaltic pump, the rotor comprising a body for rotation about an axis, the body having a first side and a second side, the body supporting a plurality of spaced first rollers extending from the body on the first side, the first rollers positioned at a first common radius from the axis, the body further supporting a plurality of spaced second rollers extending from the body on the second side, the second rollers positioned at a second common radius from the axis, wherein:

the position of the plurality of first rollers is phase shifted with respect to that of the plurality of second rollers;

each of the plurality of first rollers is arranged to contact two of the plurality of second rollers; and each of the plurality of second rollers is arranged to contact two of the plurality of first rollers.

2. The rotor of claim 1, wherein:

the spacing between the plurality of first rollers is substantially the same as that between the plurality of second rollers;

the first common radius is substantially equal to the second common radius.

3. The rotor of claim 2, wherein the rotor body has a generally planar form and is provided with recesses in the first and second side to receive the first and second rollers respectively, the recesses meeting within the body to allow contact between the first and second rollers.

4. The rotor of claim 2, wherein the body comprises two planar parts, a first rotor part providing the first side of the rotor and a second rotor part providing the second side of the rotor, the first and second rotor parts being mutually engageable to retain the first and the second rollers between them, each of the first and second rotor parts having a plurality of apertures sized to allow the first and second rollers to extend therethrough while remaining captive between the first and the second roller parts, wherein the engagement between the first and the second roller parts provides that the plurality of apertures in the first roller part is out of phase with the plurality of apertures in the second roller part.

5. A peristaltic pumping unit comprising the rotor of claim 1 assembled with a first stator and a second stator, the first stator having one or more compressible fluid channels arranged to be compressed by said first rollers and the second stator having one or more compressible fluid channels arranged to be compressed by said second rollers.

6. The pumping unit of claim 5, wherein the rotor body has a generally planar form and the first and second stators each has a planar surface on or in which the one or more compressible fluid channels are provided, wherein the rotor body is sandwiched between the first and second stators to provide substantially the same compression on the one or more fluid channels of the first stator as that on the one or more fluid channels of the second stator.

7. The pumping unit of claim 6, wherein a separation between the first and second stators can be adjusted to adjust the compression on the one or more fluid channels.

8. The pumping unit of claim 5, wherein the first stator includes multiple fluid channels, each of which includes an arcuate portion at or substantially at said first common radius from the axis.

9. The pumping unit of claim 8, wherein the arcuate portion is of a length greater than the spacing between the spaced first rollers, such that the arcuate portion is simultaneously compressed by at least two rollers of said plurality of first rollers.

10. The pumping unit of claim 5, wherein the first stator is at least partly formed by a compressible material forming a substantially planar surface and compressible arcuate portions of multiple fluid channels at different radii, each fluid channel arranged to be compressed by a different plurality of rollers to drive flow in that fluid channel, including one or more recesses in the compressible material shaped and positioned to relieve compression of a particular fluid channel by passage of rollers not in the plurality of rollers arranged to drive fluid flow in that particular fluid channel.

11. A peristaltic pumping assembly, comprising a plurality of pumping units in accordance with claim 5, stacked to align the axis of each rotor, including a drive shaft configured to engage and rotate each rotor.

12. A rotor for a peristaltic pump, the rotor comprising a body for rotation about an axis, the body having a first side and a second side, the body supporting a plurality of spaced first rollers extending from the body on the first side, the first rollers positioned at a first common radius from the axis, the body further supporting a plurality of spaced second rollers extending from the body on the second side, the second rollers positioned at a second common radius from the axis, the rotor including a further plurality of spaced first rollers extending from the body on the first side, the further plurality of spaced first rollers positioned at a third common radius from the axis different from said first common radius, additionally including a further plurality of spaced second rollers extending from the body on the second side, the further plurality of spaced second rollers positioned at a fourth common radius from the axis different from said second common radius.

13. The rotor of claim 12, wherein:

the spacing between the further plurality of first rollers is substantially the same as that between the further plurality of second rollers;

the third common radius is substantially equal to the fourth common radius;

the position of the further plurality of first rollers is phase shifted with respect to that of the further plurality of second rollers; and each of the further plurality of first rollers is arranged to contact two of the further plurality of second rollers, and each of the further plurality of second rollers is arranged to contact two of the further plurality of first rollers.

14. The rotor of claim 12, wherein:

the spacing between the plurality of first rollers is substantially the same as that between the plurality of second rollers;

the first common radius is substantially equal to the second common radius;

the position of the plurality of first rollers is phase shifted with respect to that of the plurality of second rollers; and each of the plurality of first rollers is arranged to contact two of the plurality of second rollers, and each of the plurality of second rollers is arranged to contact two of the plurality of first rollers.

15. The rotor of claim 14, wherein the rotor body has a generally planar form and is provided with recesses in the first and second side to receive the first and second rollers respectively, the recesses meeting within the body to allow contact between the first and second rollers.

16. The rotor of claim 14, wherein the body comprises two planar parts, a first rotor part providing the first side of the rotor and a second rotor part providing the second side of the rotor, the first and second rotor parts being mutually engageable to retain the first and the second rollers between them, each of the first and second rotor parts having a plurality of apertures sized to allow the first and second rollers to extend therethrough while remaining captive between the first and the second roller parts, wherein the engagement between the first and the second roller parts provides that the plurality of apertures in the first roller part is out of phase with the plurality of apertures in the second roller part.

17. A peristaltic pumping unit comprising the rotor of claim 12 assembled with a first stator and a second stator, the first stator having one or more compressible fluid channels arranged to be compressed by said first rollers and the second stator having one or more compressible fluid channels arranged to be compressed by said second rollers.

18. The pumping unit of claim 17, wherein the rotor body has a generally planar form and the first and second stators each has a planar surface on or in which the one or more compressible fluid channels are provided, wherein the rotor body is sandwiched between the first and second stators to provide substantially the same compression on the one or more fluid channels of the first stator as that on the one or more fluid channels of the second stator.

19. The pumping unit of claim 18, wherein a separation between the first and second stators can be adjusted to adjust the compression on the one or more fluid channels.

20. The pumping unit of claim 17, wherein the first stator includes multiple fluid channels, each of which includes an arcuate portion at or substantially at said first common radius from the axis.

21. The pumping unit of claim 20, wherein the arcuate portion is of a length greater than the spacing between the spaced first rollers, such that the arcuate portion is simultaneously compressed by at least two rollers of said plurality of first rollers.

22. The pumping unit of claim 17, wherein the first stator is at least partly formed by a compressible material forming a substantially planar surface and compressible arcuate portions of multiple fluid channels at different radii, each fluid channel arranged to be compressed by a different plurality of rollers to drive flow in that fluid channel, including one or more recesses in the compressible material shaped and positioned to relieve compression of a particular fluid channel by passage of rollers not in the plurality of rollers arranged to drive fluid flow in that particular fluid channel.

23. A peristaltic pumping assembly, comprising a plurality of pumping units in accordance with claim 17, stacked to align the axis of each rotor, including a drive shaft configured to engage and rotate each rotor.

* * * * *